US006155147A

United States Patent [19]

Dzieman

[11] Patent Number: 6,155,147

[45] **Date of Patent: *Dec. 5, 2000**

[54] TORQUE SCREWDRIVER WITH INDEXING MEANS LOCK

[75] Inventor: Stephen E. Dzieman, Bartlett, Ill.

[73] Assignee: Ryeson Corporation, Franklin Park, Ill.

[ * ] Notice: This patent is subject to a terminal disclaimer.

[21] Appl. No.: 09/149,647

[22] Filed: Sep. 8, 1998

[51] Int. Cl.[7] ..... B25B 23/157

[52] U.S. Cl. ..... 81/473; 81/467; 81/474

[58] Field of Search ..... 81/473, 474–476, 81/467

[56] References Cited

U.S. PATENT DOCUMENTS 3,001,430 9/1961 Cranford ..... 81/474
4,041,811 8/1977 Durant ..... 81/476
4,063,474 12/1977 Klopping ..... 81/474
4,867,019 9/1989 Lankry ..... 81/474
4,901,610 2/1990 Larson et al. ..... 81/473

*Primary Examiner*—James G. Smith
*Assistant Examiner*—Lee Wilson
*Attorney, Agent, or Firm*—Marshall, O'Toole, Gerstein, Murray & Borun

[57] ABSTRACT

An improved torque limiting screwdriver including a shaft extending from a first end of the screwdriver body, the shaft including a first plurality of indicia thereon, and an adjustment cap arranged to be located at a second end of the screwdriver body. The adjustment cap rotatable to selectively engage a selected detent located on the bottom of the adjustment cap. A lock pin arranged to engage one of the detents to retain the adjustment cap in its select position, maintaining an accurate specific torque value for the torque limiting screwdriver.

14 Claims, 3 Drawing Sheets

TORQUE SCREWDRIVER WITH INDEXING MEANS LOCK

BACKGROUND OF THE INVENTION

1. Field of the Invention

The present invention relates to torque screwdrivers. More particularly, the present invention is related to a torque screwdriver, including means to lock the torque screwdriver in various selected measurement units. It will lock and coordinate indexing numerals on an adjustment cap with other indexing numerals included on the shaft, allowing the operator to maintain or to select a different torque value.

2. Background Art

In the past, manufacturers of torque screwdrivers have only had screws, levels and lock rings to lock in a selected torque setting.

A search of the background art directed to the subject matter of the present invention conducted in the U.S. Patent and Trademark Office disclosed the following U.S. Pat. Nos.:

| | | | |
|---|---|---|---|
| 2,440,683 | Hattan | 3,896,540 | Ellis |
| 2,491,325 | McVey | 4,063,474 | Klopping |
| 2,729,134 | Stanton | 4,901,610 | Larson |
| 2,933,959 | McMahon | 5,501,124 | Ashby |
| 3,001,430 | Cranford | 5,662,012 | Grabovac |

A thorough review of the above-identified patents has concluded that none are believed to claim teach or disclose the particular novel combination of elements and functions set forth in the present invention. While U.S. Pat. Nos. 2,729,134, 3,001,430, 4,901,610, 5,501,124, and 5,662,012 all include locking means, it will be seen that none of these are structurally or functionally similar to the improved lock of the present invention.

Accordingly, it is the object of the present invention to selectively lock or release each torque setting selection into positive incremental and indexable positions, making possible maintenance and guaranteed accuracy of the selection of torque value settings.

Another object of the present invention is to be sure that each one of the torque value settings can be changed to a different accurate torque value.

SUMMARY OF THE INVENTION

A locking means of the present invention is utilized to insure to the user of a torque screwdriver that a torque setting selection made cannot and will not change due to accidental mishandling. To change any setting, the user must manually go back and disengage the lock pin of the present invention from its related auto-lock mechanism. Such action allows rotation of the adjustment cap to provide another setting.

As noted, this device incorporates an automatic locking system, a so-called auto-lock mechanism. This means that the adjustment cap of the torque screwdriver will normally be in a selected locked position preventing any torque value setting from being inadvertently changed.

The present invention can be best understood by the following description:

a positive lock is provided which is always engaged to prevent changing of the torque value settings selected. The user may at any time may change the torque value setting by disengaging the auto-lock mechanism. This latter operation is done by pulling back on the top of the lock pin manually. While holding the lock pin back with one hand and gripping the knob end of the torque screwdriver with the other hand, it may be now turned clockwise or counterclockwise to increase or decrease the torque value setting. On release, the lock pin reengages the auto-lock mechanism to prevent any accidental change in the torque value setting.

When changing the setting involving several rotations of the knob, it may be desirable to hold the lock pin back for a longer period of time. Accordingly, a temporary lock is provided during which the lock pin may be slid over into a lock position. This is done by pulling back on the lock pin, disengaging the auto-lock mechanism and moving it laterally to slide it over into a notch provided in the body of a torque screwdriver. This action will hold the lock pin in that position keeping it disengaged. After an appropriate torque value has been established, a lateral movement of the lock pin out of the notch will return the lock pin back into its auto-lock condition by means of the included auto-lock mechanism.

The scale of torque value settings in a given measurement of some predetermined units (e.g., inch-ounces) may consist of several increment lines. For example, a typical scale as utilized in torque screwdrivers might be incremented from 10 to 50 in inch-ounces of torque. It then being divided up into 10s.

Utilization of this arrangement would limit the user to setting the torque to one of only five choices. As in the past, settings and locking in between these choices had been done by guessing the values based on a half-turn, quarter-turn, half the distance between two lines, all of which are less than desirable and lack the necessary desirable accuracy.

The present invention, accordingly, was designed to eliminate guesswork, locking in selected settings of the torque in the device.

In the adjusting cap at the upper end, positive alignment is given to the setting of the tool. It aligns the marked numbers on the cap to an index mark on the handle, showing the operator the secondary setting they have selected. Such setting are locked by the lock of the present invention.

The setting established as described above is now the torque value that will be delivered to the fastener upon activation. If required, the torque value setting may be changed by operating the described lock to a release position and turning the cap on the upper end of the screwdriver in a clockwise or counterclockwise rotation.

As seen from the foregoing, the improvement in the present invention comprises a lock for a cap member arranged to be located at one end of the usual screwdriver body. It can be seen that rotation of the cap relative to the body adjusts the torque of the screwdriver. The lock insures the integrity of the torque setting.

The interior mechanism and drive mechanism of the present screwdriver, with the exception of the upper cap shown in my copending application Ser. No. 09/149,840, and its associated settings, is similar to that found in U.S. Pat. No. 4,063,474 which issued on Dec. 20, 1997 to Klopping.

The foregoing and additional objects and advantages of the invention will become more apparent as the following detailed description is read in conjunction with the accompanying drawings.

DESCRIPTION OF THE PREFERRED EMBODIMENT

Figure 1:
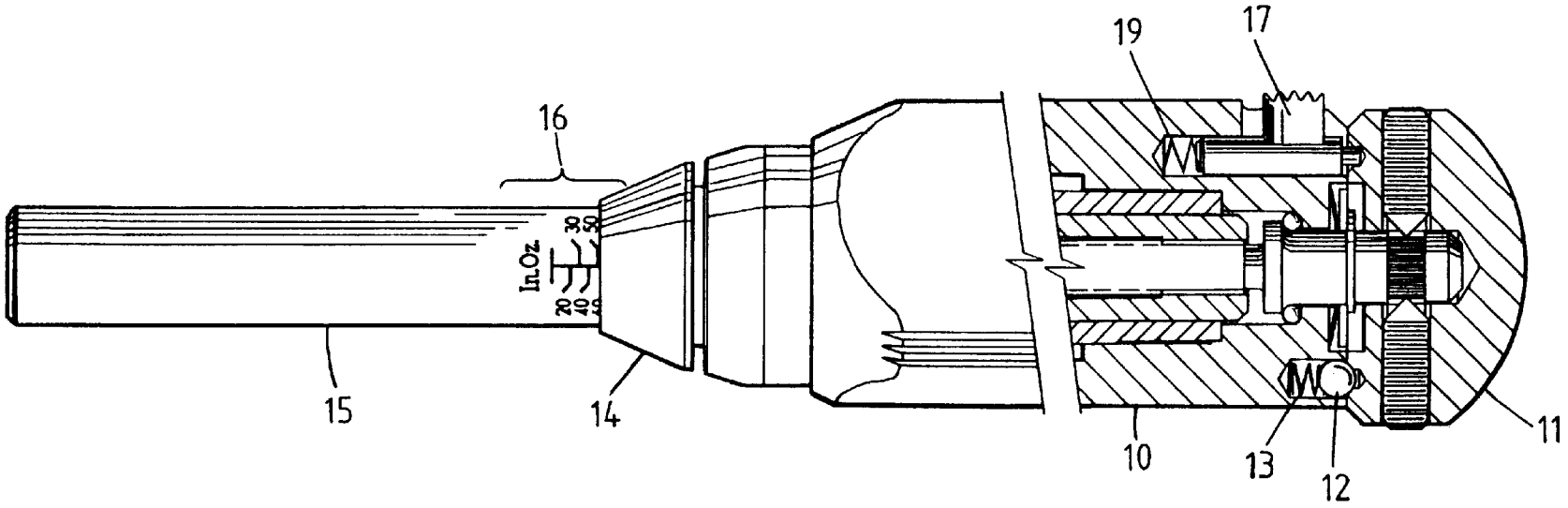
FIG. 1 is a partial plan view of the present invention with the upper portion sectionalized to show the relationship between the adjustable end cap and the internal lock of the torque screwdriver.
Figure 7:
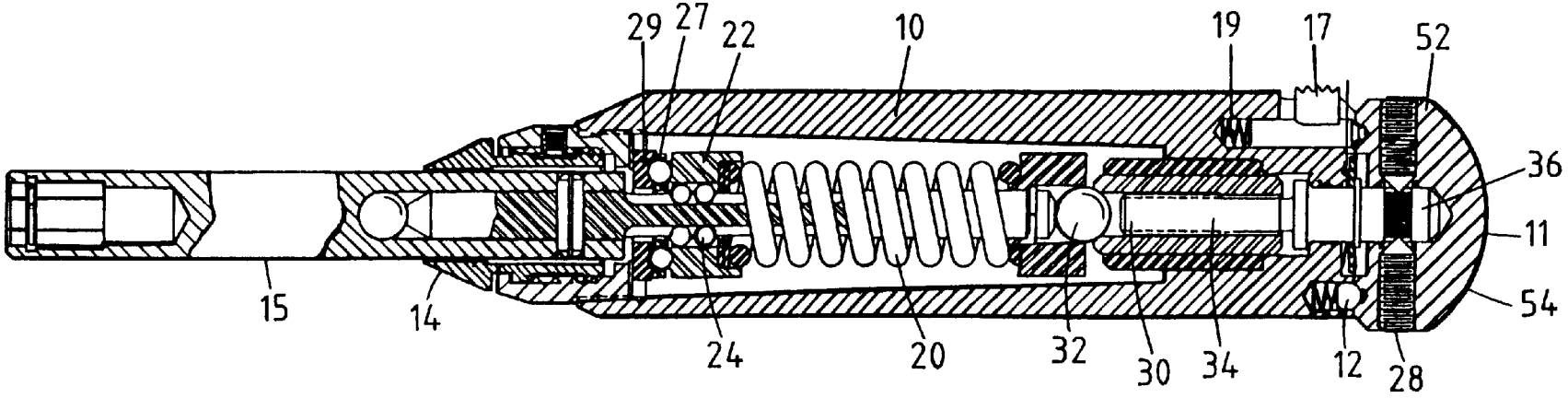
FIG. 7 is a sectional view of the screwdriver of the present invention.

Referring first to FIGS. 1 and 7, the body 10 of the torque screwdriver, as noted previously, is similar to that found in U.S. Pat. No. 4,063,474. Of particular interest in the present invention is the lock pin 17 shown positioned in the body 10 and as seen in the sectional view. The lock pin 17 protrudes partially into the lower side of the adjustment cap 11. The lock pin is retained in its position by means of compression spring 19. At the lower end of the screwdriver, in a manner similar to that described in the previous reference, is a shaft 15. At the lower end of shaft 15, the screwdriver of the present invention accepts screwdriver bits in a manner well known to the prior art. Located on shaft 15 are indexing markings 16 which are shown in inch ounces in the present invention. It is to be understood that those markings could be changed to metric equivalents, if so desired.

Figure 3:
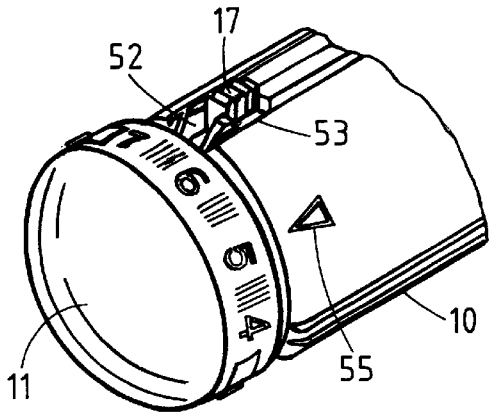
FIGS. 3 and 4 are perspective views showing how the lock pin mechanism retracts from adjustment end cap of the screwdriver.
Figure 8:
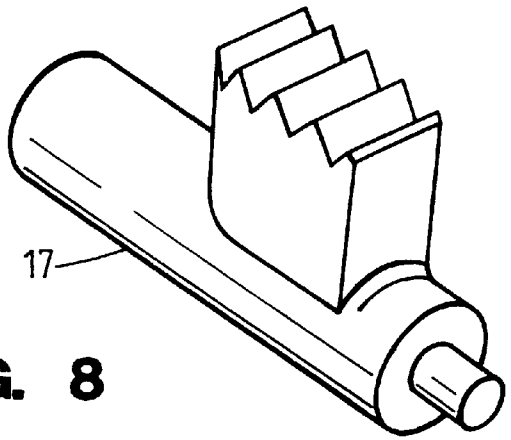
FIG. 8 is a perspective view of the lock pin of the present invention.

As seen in FIG. 3, the lower end of adjustment cap 11 includes a plurality of detents 18 arranged in a detent circle form. The detents 18, located on the lower side of adjustment cap 11, are concave openings slightly smaller than half the diameter of ball bearing 12. Each detent includes a center area 18A drilled to receive the pin or upper end of lock pin 17, as seen in FIG. 8. Included and also shown is ball bearing 12 which is retained in its proper position in the detents 18 by compression spring 13 as shown in FIGS. 1 & 7. In a similar manner, FIG. 3 shows the lock pin detents 18 on the lower side of adjustment cap 11. It can also readily be seen that lock pin 17 is retained in position by compression spring 19, mating with the various detents 18 as the adjustment cap 11 is rotated relative to the body 10.

As shown in FIG. 7, the right end portion of the torque adjusting screw 34 is unthreaded and extends into the adjustment cap 11. The adjustment cap 11 is secured to the end of adjustment screw 34 by screw 28 and extends through a portion of the adjustment cap whereby the adjustment cap 11 can be moved axially with respect to adjusting screw 34.

A spring loaded ball 32 is located at the opposite end of adjustment screw 34 from adjustment cap 11. It operates in conjunction with adjustment cap 11. Lock pin 17, as can be seen in FIG. 7, extends via the adjustment cap 11 into engagement with a detent 18A in adjustment cap 11 to positively lock the cap 11 in the position illustrated when desired.

Figure 4:
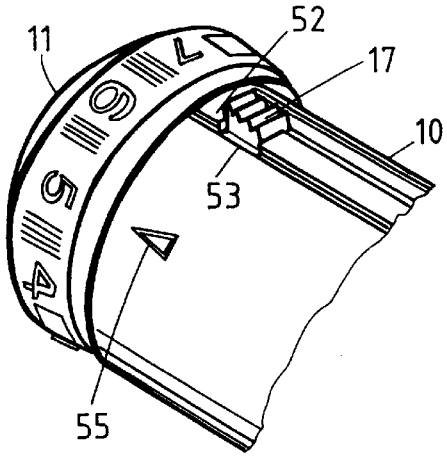
Figure 5:
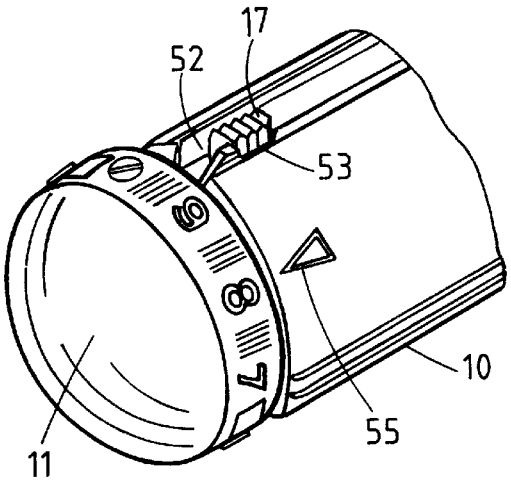
FIGS. 5 and 6 are perspective views of the lock pin and adjustment end cap showing how the lock pin of the present invention may be locked in the disengage mode.
Figure 6:
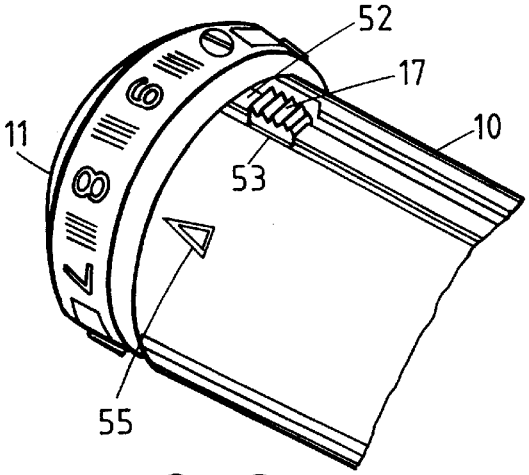

The auto-lock mechanism feature consists of lock pin 17 designed as a positive engagement into the adjustment cap 11 of torque screwdriver 10. As seen in FIGS. 3, 4, 5, and 6, the hole 52 in a slot 53 is located in handle 10 of the torque screwdriver providing lateral movement required for lock pin 17 to engage the adjustment cap 11 in the auto-lock position and disengage the auto-lock feature when pulled back out of engagement position as shown in FIGS. 3 and 4.

The force required to keep the lock pin 17 engaged forward normally into the auto-lock position of the adjustment cap 11 of torque screwdriver 10 is provided by compression spring 19 located behind the lock pin 17 in the slot 52 of the torque screwdriver handle 10. The slot 52 formed in the handle 10 also provides an additional pocket or notch 53 in which the top of lock pin 17 can be slid over to provide a temporary disengagement of the auto-lock mechanism during large torque value setting changes. Sliding the top of lock pin 17 back into the free movement area 52 of the slot allows the auto lock mechanism to be engaged.

The torque screwdriver of the present invention will achieve a positive placement for setting that will accurately give the operator an exact torque value setting. Each rotational adjustment of the cap 11 end when operated in either a clockwise or counterclockwise direction will nest ball bearing 12 into an associated detent 18. As can be seen in FIGS. 3, 4, 5, and 6, each setting has a corresponding mark showing its set value, which may be aligned with an index mark 55 on body 10. The marking 16 on shaft 15 is referred to as the major scale and is indicated by lines. Selected marking 16 appears past the lower edge of thimble 14. The marks on the adjustment cap 11 comprise a minor scale indicated by an index mark 55 on the body 10. In combination, the markings on the major scale and minor scale added together provide the operator with a set torque value that the screwdriver of the present invention will deliver.

Figure 2:
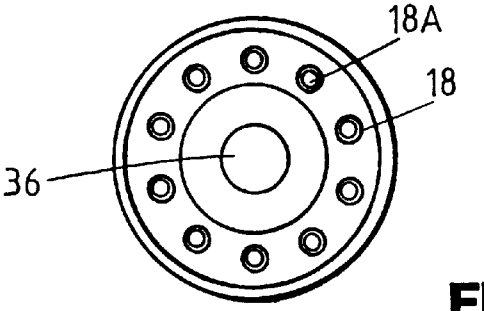
FIG. 2 is a view of the underside or side facing the body of the adjustment cap, showing the plurality of detents positioned in a circle included therein.

As shown in the present invention, in FIG. 2, the adjustment cap is divided at its lower end into ten detents giving the operator a choice of ten different settings. Each would have a corresponding mark on the exterior body of the circumference of the outer edge of adjustment cap 11 as seen in FIGS. 3, 4, 5, and 6. In use, the operator will feel the setting nesting itself in an exact placement corresponding to the torque value selected; each movement providing a click stop for each selected value.

While but a single embodiment of the present invention has been shown, it will be obvious to those skilled in the art that numerous modifications may be made without departing from the spirit of the present invention, which shall be limited only by the scope of the claims appended hereto.

What is claimed is:

1. An improved torque limiting screwdriver including a shaft extending from a first end of a body, said shaft including a bit receptacle on an extended end of said shaft, said shaft including a first plurality of indicia thereon, an adjustment cap located at a second end of said body having a bottom surface, the improvement comprising:

a lock pin located at a second end of said body;

a plurality of spaced detents on the bottom surface of said adjustment cap;

said lock pin mounted on said body including a first end adapted to engage one of said detents.

2. An improved torque limiting screwdriver as claimed in claim 1 wherein:

said lock pin is spring loaded in said second end of said body;

said spring urging said lock pin first end into engagement with said detent.

3. An improved torque limiting screwdriver as claimed in claim 1 wherein:

said body second end includes a slot for mounting said lock pin between first and second selected positions.

4. An improved torque limiting screwdriver as claimed in claim 3 wherein:

said body second end includes a notch adjacent to said slot for locking said lock pin in said second position.

5. An improved torque limiting screwdriver as claimed in claim 3 wherein:

said lock pin comprises a cylindrical pin and control means attached thereto adapted to selectively move said cylindrical pin from a first to a second position, said control means positioned within said slot.

6. An improved torque limiting screwdriver as claimed in claim 5 wherein:

said control means are manually further operated to insert said control means into a notch associated with said slot.

7. An improved torque limiting screwdriver as claimed in claim 5 wherein:

said lock pin is manually operated to position said control means in said notch.

8. An improved torque limiting screwdriver as claimed in claim 1 wherein:

said detents each include a center opening adapted to receive said lock pin.

9. An improved torque limiting screwdriver as claimed in claim 8 wherein:

said lock pin includes a first end adapted to engage said center opening in a selected one of said detents.

10. An improved torque limiting screwdriver as claimed in claim 1 wherein:

a different second indicia is located adjacent to each one of said detents to provide an index in response to rotation of said adjustment cap relative to an index point on said body.

11. An improved torque limiting screwdriver as claimed in claim 1 wherein:

the first indicia of said shaft are indexed relative to said body;

said adjustment cap rotatable to selectively engage any one of said detents located on the bottom of said adjustment cap, whereby in response to the indexing of said first indicia on said shaft and the selective rotation of said adjustment cap is aligned with a second indicia associated with the selected one of said detents;

said indexing of said first indicia on said shaft and said second indicia located on said adjustment cap in combination having an accurate specific value for said torque limiting screwdriver;

said lock pin engaging a different one of said detents whereby said accurate and specific value for said torque screwdriver is locked into place.

12. An improved torque limiting screwdriver as claimed in claim 1 wherein:

said body second end includes a slot for movement of said lock pin between a first and a second position;

said body second end further including a notch associated with said slot for locking said locking means in a third position adjacent to said second portion of said slot.

13. An improved torque limiting screwdriver as claimed in claim 1 wherein:

said second end of said body includes a slot for accessing said lock pin means;

said lock pin further adapted to be manually moved from a first to a second position within said slot;

a notch connected to and associated with said slot adapted to receive movement of said control means from a position in said slot to said notch;

whereby said locking means are retained in a locked non-engaging position with said selected detent.

14. An improved torque limiting screwdriver including a shaft extending from a first end of a body, said shaft including a bit receptacle, and the shaft including a first plurality of indicia thereon, an adjustment cap arranged to be located at a second end of said body;

and lock means included in said body for securing said adjustment cap in a selected position adjacent to the body of said screwdriver;

said adjustment cap including a plurality of spaced detents on the bottom surface of said adjustment cap;

a locking pin mounted at the second end of said body, adapted to selectively engage any one of said detents;

said adjustment cap rotatable to selectively position any one of said detents located on the bottom of said adjustment cap adjacent to said locking pin whereby said pin moves into contact with said selected detent.

* * * * *